US009238163B2

(12) United States Patent
Slater et al.

(10) Patent No.: US 9,238,163 B2
(45) **Date of Patent: *Jan. 19, 2016**

(54) BALL BAT INCLUDING A FIBER COMPOSITE COMPONENT HAVING HIGH ANGLE DISCONTINUOUS FIBERS

(71) Applicant: Wilson Sporting Goods Co., Chicago, IL (US)

(72) Inventors: Brent R. Slater, Vancouver, WA (US); Brian S. Hayes, Benicia, CA (US); Richard E. Moritz, Portland, OR (US); Sean S. Epling, Portland, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 122 days.

This patent is subject to a terminal disclaimer.

(21) Appl. No.: 13/938,830

(22) Filed: Jul. 10, 2013

(65) Prior Publication Data

US 2015/0018139 A1 Jan. 15, 2015

(51) Int. Cl.
*A63B 59/06* (2006.01)
*A63B 71/06* (2006.01)

(52) U.S. Cl.
CPC ..... *A63B 59/06* (2013.01); *A63B 59/50* (2015.10); *A63B 2071/0694* (2013.01); *A63B 2102/18* (2015.10); *A63B 2209/023* (2013.01)

(58) Field of Classification Search
CPC ..... A63B 59/06; A63B 2209/00; A63B 2209/02; A63B 2209/023
USPC ..... 473/457, 519, 520, 564–568
See application file for complete search history.

(56) References Cited

U.S. PATENT DOCUMENTS

| | | | | | |
|---|---|---|---|---|---|
| 3,861,682 | A | | 1/1975 | Fujii | 273/72 |
| 3,963,239 | A | | 6/1976 | Fujii | 273/72 |
| 3,972,528 | A | | 8/1976 | McCracken et al. | 273/72 |
| 4,644,630 | A | | 2/1987 | Blum | 29/453 |
| 4,848,745 | A | * | 7/1989 | Bohannan et al. | 473/119 |
| 4,951,948 | A | | 8/1990 | Peng | 273/72 |
| 5,094,453 | A | | 3/1992 | Douglas et al. | 273/72 |
| 5,364,095 | A | | 11/1994 | Easton et al. | 273/72 |
| 5,395,108 | A | | 3/1995 | Souders et al. | 273/72 |
| 5,415,398 | A | | 5/1995 | Eggiman | 273/72 |
| 5,421,572 | A | | 6/1995 | MacKay, Jr. | 473/566 |
| 5,593,158 | A | | 1/1997 | Filice et al. | 473/520 |
| 5,676,610 | A | | 10/1997 | Bhatt et al. | 473/566 |
| 5,899,823 | A | | 5/1999 | Eggiman | 473/566 |
| 5,931,750 | A | | 8/1999 | MacKay, Jr. | 473/566 |
| 5,961,405 | A | | 10/1999 | MacKay, Jr. | 473/566 |
| 5,964,673 | A | | 10/1999 | MacKay, Jr. | 473/566 |
| 6,042,493 | A | | 3/2000 | Chauvin et al. | 473/566 |

(Continued)

*Primary Examiner* — Mark Graham
(74) *Attorney, Agent, or Firm* — Terence P. O'Brien

(57) ABSTRACT

A ball bat extending about a longitudinal axis. The bat includes a barrel portion defining a primary tubular ball impact region. The barrel portion is formed of a fiber composite material. The fiber composite material includes at least first and second plies. The first and second plies include first and second pluralities first and second resins, respectively. Substantially all of the first and second pluralities of fibers of the first and second plies are generally aligned to define first and second angles with respect to the axis, respectively. The angles are each within the range of 45 to 90 degrees. Each of the plies is sized to extend about the full circumference of the barrel portion. The first and second pluralities of fibers are sectioned such that the fibers do not continuously extend about the full circumference of the impact region.

18 Claims, 10 Drawing Sheets

(56) References Cited

U.S. PATENT DOCUMENTS

| | | | | |
|---|---|---|---|---|
| 6,045,467 | A | 4/2000 | Anderson | 473/568 |
| 6,056,655 | A | 5/2000 | Feeney et al. | 473/567 |
| 6,099,422 | A | 8/2000 | Rappaport et al. | 473/567 |
| 6,176,795 | B1 | 1/2001 | Schullstrom | 473/566 |
| 6,248,032 | B1 | 6/2001 | Filice et al. | 473/566 |
| 6,251,034 | B1 | 6/2001 | Eggiman et al. | 473/567 |
| 6,287,221 | B1 | 9/2001 | Pino | 473/564 |
| 6,334,824 | B1 | 1/2002 | Filice et al. | 473/566 |
| 6,334,825 | B1 | 1/2002 | Buiatti | 473/566 |
| 6,352,485 | B1 * | 3/2002 | Philpot et al. | 473/564 |
| 6,383,101 | B2 | 5/2002 | Eggiman | 473/567 |
| 6,432,007 | B1 | 8/2002 | Filice et al. | 473/566 |
| 6,482,114 | B1 | 11/2002 | Eggiman et al. | 473/566 |
| 6,485,382 | B1 | 11/2002 | Chen | 473/566 |
| 6,497,631 | B1 | 12/2002 | Fritzke et al. | 473/566 |
| 6,663,517 | B2 | 12/2003 | Buiatti et al. | 473/566 |
| 6,702,698 | B2 | 3/2004 | Eggiman et al. | 473/566 |
| 6,733,404 | B2 | 5/2004 | Fritzke et al. | 473/566 |
| 6,743,127 | B2 | 6/2004 | Eggiman et al. | 473/567 |
| 6,761,653 | B1 * | 7/2004 | Higginbotham et al. | 473/566 |
| 6,764,419 | B1 | 7/2004 | Giannetti et al. | 473/567 |
| 6,866,598 | B2 | 3/2005 | Giannetti et al. | 473/567 |
| 6,875,137 | B2 | 4/2005 | Forsythe et al. | 473/566 |
| 6,905,429 | B2 | 6/2005 | Forsythe et al. | 473/566 |
| 6,945,886 | B2 | 9/2005 | Eggiman et al. | 473/566 |
| 6,949,038 | B2 | 9/2005 | Fritzke | 473/566 |
| 6,991,551 | B2 | 1/2006 | Tolentino et al. | 473/167 |
| 6,997,826 | B2 | 2/2006 | Sutherland | 473/567 |
| 7,014,580 | B2 | 3/2006 | Forsythe et al. | 473/566 |
| 7,044,871 | B2 | 5/2006 | Sutherland et al. | 473/564 |
| 7,097,578 | B2 | 8/2006 | Guenther et al. | 473/567 |
| 7,115,054 | B2 | 10/2006 | Giannetti et al. | 473/567 |
| 7,128,670 | B2 | 10/2006 | Souders et al. | 473/567 |
| 7,140,988 | B1 | 11/2006 | Hinman | 473/566 |
| 7,163,475 | B2 | 1/2007 | Giannetti | 473/567 |
| 7,229,370 | B1 | 6/2007 | Vacek et al. | 473/567 |
| 7,232,387 | B1 | 6/2007 | Heald et al. | 473/566 |
| 7,232,388 | B2 | 6/2007 | Sutherland et al. | 473/567 |
| 7,311,620 | B1 | 12/2007 | Heald et al. | 473/566 |
| 7,361,107 | B2 | 4/2008 | Giannetti et al. | 473/567 |
| 7,384,354 | B2 | 6/2008 | Giannetti | 473/567 |
| 7,419,446 | B2 | 9/2008 | Nguyen | 473/567 |
| 7,442,134 | B2 | 10/2008 | Giannetti et al. | 473/567 |
| 7,442,135 | B2 | 10/2008 | Giannetti et al. | 473/567 |
| 7,527,570 | B2 | 5/2009 | Giannetti et al. | 473/568 |
| 7,572,197 | B2 | 8/2009 | Chauvin et al. | 473/567 |
| 7,604,184 | B1 | 10/2009 | Chen | 239/289 |
| 7,607,083 | B2 | 10/2009 | Gong et al. | 473/566 |
| 7,651,420 | B1 | 1/2010 | Gaff et al. | 473/567 |
| 7,749,115 | B1 | 7/2010 | Cruz et al. | 473/567 |
| 7,850,554 | B2 | 12/2010 | Burger | 473/567 |
| 7,857,719 | B2 | 12/2010 | Giannetti et al. | 473/567 |
| 7,896,763 | B2 | 3/2011 | Giannetti et al. | 473/568 |
| 7,914,404 | B2 | 3/2011 | Giannetti et al. | 473/566 |
| 8,052,547 | B2 | 11/2011 | Nusbaum et al. | 473/457 |
| 8,062,154 | B2 | 11/2011 | Burger | 473/567 |
| 8,182,377 | B2 | 5/2012 | Chuang et al. | 473/567 |
| 8,197,365 | B2 | 6/2012 | Tokieda | 473/566 |
| 8,197,366 | B2 | 6/2012 | Chauvin et al. | 473/566 |
| 8,282,516 | B2 | 10/2012 | Chauvin et al. | 473/566 |
| 8,298,102 | B2 | 10/2012 | Chauvin et al. | 473/566 |
| 8,317,640 | B1 | 11/2012 | Cruz et al. | 473/567 |
| 8,376,881 | B2 | 2/2013 | Chuang et al. | 473/567 |
| 8,480,519 | B2 | 7/2013 | Chauvin et al. | 473/566 |
| 8,506,429 | B2 | 8/2013 | Chauvin et al. | 473/566 |
| 2001/0034276 | A1 | 10/2001 | Brown | 473/457 |
| 2005/0227795 | A1 | 10/2005 | Fritzke | 473/564 |
| 2006/0019779 | A1 | 1/2006 | Fritzke et al. | 473/567 |
| 2008/0064538 | A1 | 3/2008 | McNamee et al. | 473/564 |
| 2009/0215559 | A1 * | 8/2009 | McNamee et al. | 473/567 |
| 2009/0215560 | A1 * | 8/2009 | McNamee et al. | 473/567 |
| 2011/0077111 | A1 | 3/2011 | Chauvin et al. | 473/566 |
| 2012/0108368 | A1 | 5/2012 | Epling et al. | 473/564 |
| 2012/0108369 | A1 | 5/2012 | Epling et al. | 473/564 |
| 2012/0108371 | A1 | 5/2012 | Epling et al. | 473/566 |
| 2013/0035181 | A1 | 2/2013 | Chauvin et al. | 473/566 |

* cited by examiner

BALL BAT INCLUDING A FIBER COMPOSITE COMPONENT HAVING HIGH ANGLE DISCONTINUOUS FIBERS

FIELD OF THE INVENTION

The present invention relates to a ball bat including a fiber composite component having high angle discontinuous fibers.

BACKGROUND OF THE INVENTION

Baseball and softball organizations periodically publish and update equipment standards and/or requirements including performance limitations for ball bats. One recently issued standard is the Bat-Ball Coefficient of Restitution ("BBCOR") Standard adopted by the National Collegiate Athletic Association ("NCAA") on May 21, 2009. The BBCOR Standard, which became effective on Jan. 1, 2011 for NCAA baseball, is a principal part of the NCAA's effort, using available scientific data, to maintain as nearly as possible wood-like baseball bat performance in non-wood baseball bats. Although wood ball bats provide many beneficial features, they are prone to failure, and because wooden ball bats are typically solid (not hollow), wooden bats can be too heavy for younger players even at reduced bat lengths. Wood ball bats also provide little or no flexibility in the design of the hitting or barrel region of the bat. Non-wood bats, such as bats formed of aluminum, other alloys, composite fiber materials, thermoplastic materials and combinations thereof, allow for performance of the bat to be more readily tuned or adjusted throughout or along the hitting or barrel portion. Such characteristics enable non-wood bats to provide more consistent performance, increased reliability and increased durability than wood bats.

Other organizations have also adopted the BBCOR Standard. For example, the National Federation of State High School Associations (NFHS) has set Jan. 1, 2012 as the effective date for implementation of the BBCOR Standard for high school play. The BBCOR Standard includes a 0.500 BBCOR bat performance limit, which specifies that no point on the barrel or hitting portion of a bat can exceed the 0.500 BBCOR bat performance limit.

Bat manufacturers, such as DeMarini, have responded by producing bats that are certified under the BBCOR Standard. These bats generally have a slightly higher moment of inertia and can have stiffer barrels or impact regions than non-BBCOR baseball bats. One approach to achieving a stiffer barrel portion or region of a bat made of a fiber composite material is to form the bat with fiber composite layers having high angle with respect to the longitudinal axis of the bat (e.g. 45 degrees and higher). The higher angle fiber layers provide more hoop strength to the cylindrical barrel portion without adding additional thickness and/or weight to the barrel portion. However, higher angle fiber composite layers can be difficult to work with because the high angle fiber layers when wrapped about a bladder during molding of the barrel portion of the bat severely restricts the expansion of the material. Accordingly, bladder molding of a barrel portion of a ball bat having high angle fiber composite layers often result in voids, low durability and poor cosmetic appearance. Compounding the concern is the material costs. Fiber composite material is very expensive and any condition that results in an increase in production time, production cost or waste is highly undesirable. Bladder molding of a barrel portion of a ball bat having high angle fiber composite layers often results in barrel portions exhibiting poor and/or undesirable reliability, durability and/or an undesirable appearance.

Accordingly, a need exists to develop a method and/or system for forming barrel portions of a ball bat or other cylindrical portions of a ball bat using fiber composite material having high fiber angles in a cost effective, reliable and high quality manner. What is needed is a system or process of developing a ball bat formed at least in part of high angle fiber composite material that provides a high quality cosmetic appearance, is highly durable, and provides the desired operational characteristics. It would be advantageous to provide a ball bat, and a system or method for producing a ball bat including a barrel portion formed of a high angle fiber composite material, that can satisfy performance requirements, such as BBCOR certification, without adding too much weight or wall thickness to the barrel portion. It would be advantageous to provide a ball bat with a desirable level of barrel stiffness, and provides exceptional feel and performance.

SUMMARY OF THE INVENTION

The present invention provides a ball bat extending about a longitudinal axis. The ball bat includes a barrel portion defining a primary tubular region. The primary tubular region is formed of a fiber composite material having wall thickness of at least 0.100 inch. The fiber composite material includes at least first and second plies. The first ply includes a first plurality of fibers aligned adjacent to one another and a first resin. The second ply includes a second plurality of fibers aligned adjacent to one another and a second resin. Substantially all of the first and second pluralities of fibers of the first and second plies are generally aligned to define first and second angles with respect to the longitudinal axis, respectively. The first and second angles are each within the range of 45 to 90 degrees. The first and second plies have opposite polarities and are positioned with the second ply applied directly over the first ply. The first and second pluralities of fibers are sectioned such that the fibers do not continuously extend about the full circumference of the primary tubular region.

According to a principal aspect of a preferred form of the invention, a ball bat extending about a longitudinal axis. The ball bat includes a barrel portion defining a primary tubular region. The barrel portion is formed at least in part of a fiber composite material. The fiber composite material includes at least first and second plies. The first ply includes a first plurality of fibers aligned adjacent to one another and a first resin. The second ply includes a second plurality of fibers aligned adjacent to one another and a second resin. Substantially all of the first and second pluralities of fibers of the first and second plies are generally aligned to define first and second angles with respect to the longitudinal axis, respectively. The first and second angles are each within the range of 45 to 90 degrees. Each of the first and second plies is sized to extend about the full circumference of the barrel portion. The first and second pluralities of fibers are sectioned such that the fibers do not continuously extend about the full circumference of the primary tubular region.

According to a principal aspect of another preferred form of the invention, a ball bat extending about a longitudinal axis. The ball bat includes a barrel portion defining a primary tubular ball impact region. The barrel portion is formed at least in part of a fiber composite material. The fiber composite material includes at least first, second and third plies. The first ply includes a first plurality of fibers aligned adjacent to one another and a first resin. The second ply includes a second plurality of fibers aligned adjacent to one another and a second resin. The third ply includes a third plurality of fibers aligned adjacent to one another and a third resin. Substantially all of the first, second and third pluralities of fibers of the first, second and third plies are generally aligned to define first, second and third angles with respect to the longitudinal axis, respectively. The first, second and third angles are each within the range of 45 to 90 degrees. Each of the first, second and third plies is sized to extend about the circumference of the barrel portion. The first, second and third pluralities of fibers are sectioned such that the fibers do not continuously extend about the full circumference of the primary tubular ball impact region.

According to another principal aspect of a preferred form of the invention, a method of bladder molding a barrel portion of a ball bat wherein the barrel portion includes a primary tubular ball impact region. The method includes the steps of obtaining a bladder and a mandrel, and placing the bladder over the mandrel. The method further includes obtaining multiple plies of fiber composite material including at least first and second plies of fiber composite material having high angle. The first ply includes a first plurality of fibers aligned adjacent to one another and a first resin. The second ply includes a second plurality of fibers aligned adjacent to one another and a second resin. Substantially all of the first and second pluralities of fibers of the first and second plies are generally aligned to define first and second angles with respect to the longitudinal axis, respectively. The first and second angles are each within the range of 45 to 90 degrees. Each of the first and second plies is sized to extend about the circumference of the barrel portion. The method further includes sectioning the first and second pluralities of high angle fibers in a predetermined pattern such that the fibers do not continuously extend about the full circumference of the barrel portion or a primary tubular region thereof. The method continues to include wrapping the first and second plies and additional plies of fiber composite material about the bladder, and optionally obtaining and including one or more layers of release material (such as a scrim or a veil), and placing the at least one layer of release material between at least two of the plies. The method further includes molding and curing the plies to form the barrel portion of the ball bat or a primary tubular region of the barrel portion.

This invention will become more fully understood from the following detailed description, taken in conjunction with the accompanying drawings described herein below, and wherein like reference numerals refer to like parts.

DETAILED DESCRIPTION OF THE INVENTION

Figure 1:
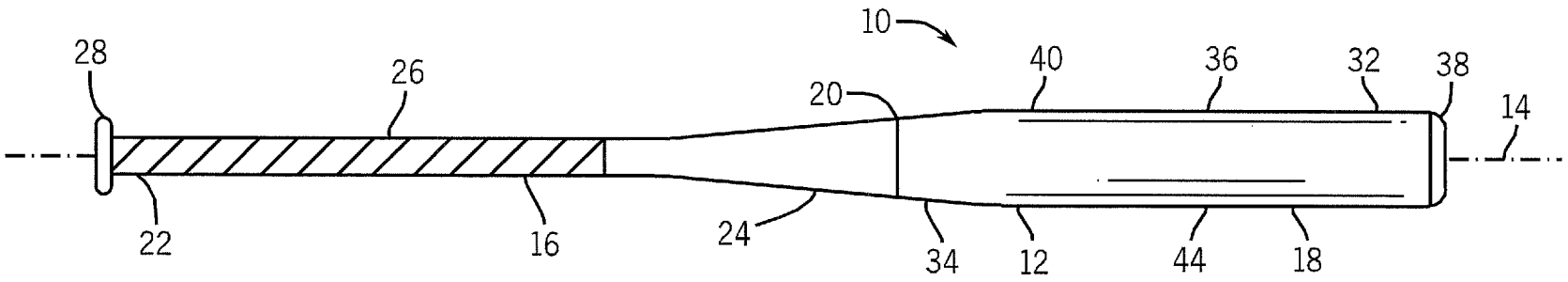
FIG. 1 is a side view of a ball bat in accordance with a preferred embodiment of the present invention.

Referring to FIG. 1, a ball bat is generally indicated at 10. The ball bat 10 of FIG. 1 is configured as a baseball bat; however, the invention can also be formed as a softball bat, a rubber ball bat, or other form of ball bat. The bat 10 includes a frame 12 extending along a longitudinal axis 14. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches.

The frame 12 has a relatively small diameter handle portion 16, a relatively larger diameter barrel portion 18 (also referred as a hitting or impact portion), and an intermediate tapered region 20. The intermediate tapered region 20 can be formed by the handle portion 16, the barrel portion 18 or a combination thereof. In one preferred embodiment, the handle and barrel portions 16 and 18 of the frame 12 can be formed as separate structures, which are connected or coupled together. This multi-piece frame construction enables the handle portion 16 to be formed of one material, and the barrel portion 18 to be formed of a second, different material (or two or more different materials).

The handle portion 16 is an elongate structure having a proximal end region 22 and a distal end region 24, which extends along, and diverges outwardly from, the axis 14 to form a substantially frusto-conical shape for connecting or coupling to the barrel portion 18. Preferably, the handle portion 16 is sized for gripping by the user and includes a grip 26, which is wrapped around and extends longitudinally along the handle portion 16, and a knob 28 connected to the proximal end 22 of the handle portion 16. The handle portion 16 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof.

Figure 2:
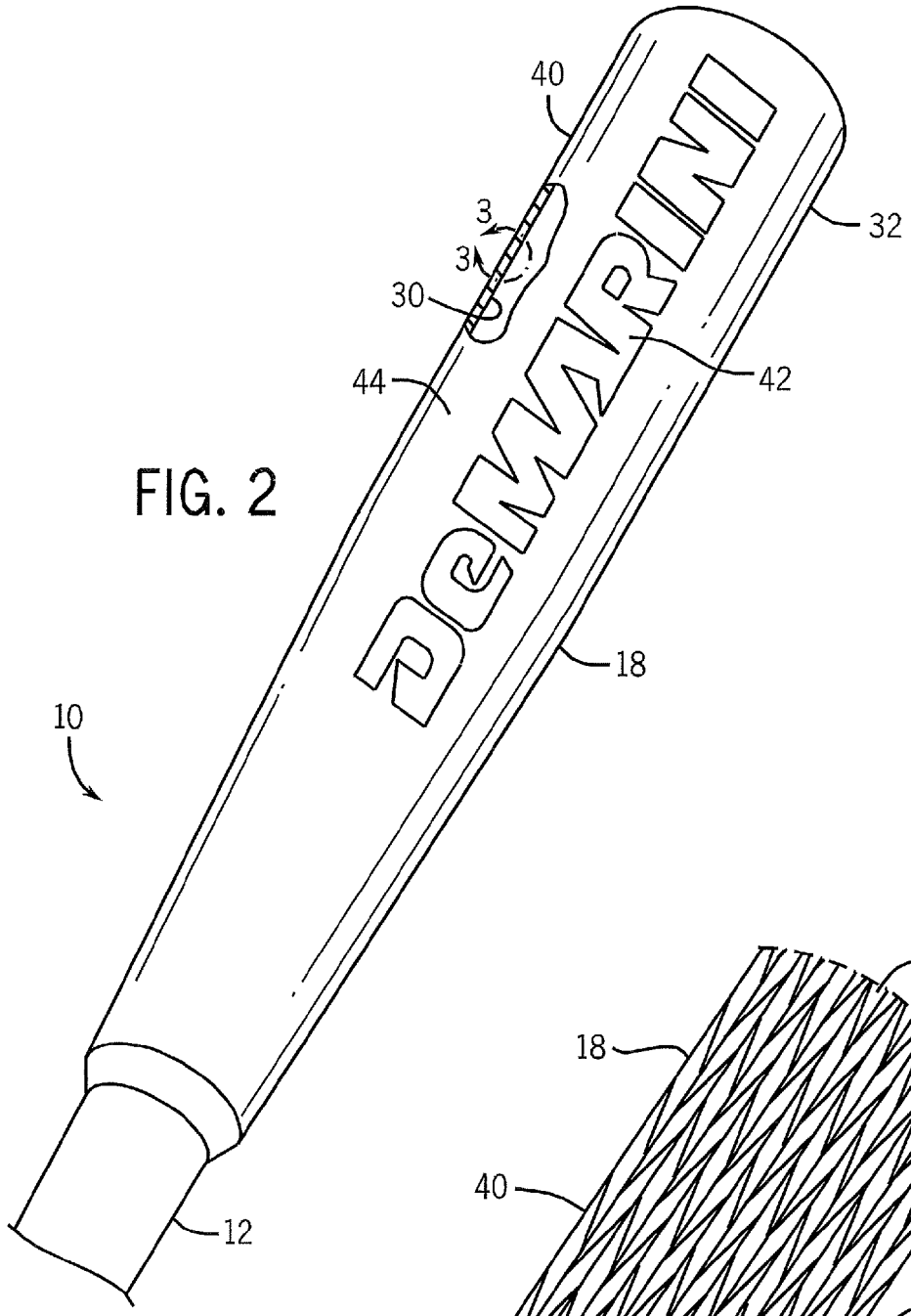
FIG. 2 is a side perspective view of a barrel portion of the ball bat of FIG. 1 including a sectional view of the wall of the barrel portion.

Referring to FIGS. 1 and 2, the barrel portion 18 of the frame 12 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. The barrel portion 18 extends along the axis 14 and has an inner surface 30, an outer surface 40, a distal end region 32, a proximal end region 34, and a central region 36 disposed between the distal and proximal end regions 32 and 34. The proximal end region 34 converges toward the axis 14 in a direction toward the proximal end of the barrel portion 18 to form a frusto-conical shape that is complementary to the shape of the distal end region 24 of the handle portion 16. The barrel portion 18 can be directly connected to the handle portion 16. The connection can involve a portion, or substantially all, of the distal end region 24 or tapered region 20 of the handle portion 16 and the proximal end region 34 of the barrel portion 18. Alternatively, an intermediate member can be used to space apart and/or attach the handle portion 16 to the barrel portion 18. The intermediate member can space apart all or a portion of the barrel portion 16 from the handle portion 16, and it can be formed of an elastomeric material, an epoxy, an adhesive, a plastic or any conventional spacer material. The bat 10 further includes an end cap 38 attached to the distal end 32 of the barrel portion 18 to substantially enclose the distal end 32.

The handle and barrel portions 16 and 18 can be coated and/or painted with one or more layers of paint, clear coat, inks, coatings, primers, and other conventional outer surface coatings. The outer surface 40 of the barrel portion 18 and/or the handle portion 16 can also include alpha numeric and/or graphical indicia 42 indicative of designs, trademarks, graphics, specifications, certifications, instructions, warnings and/or markings. Indicia 42 can be a trademark that is applied as a decal, as a screening or through other conventional means.

The barrel portion 18 includes a primary tubular ball impact region 44 that defines the region of the barrel portion 18 that is commonly or preferably used for impacting a ball during use. The ball impact region 44 includes the location of the bat barrel portion 18 referred to as the "sweet spot" or the location of the center of percussion ("COP") of the ball bat 10. The COP is typically identified in accordance with ASTM Standard F2219-09, *Standard Test Methods for Measuring High-Speed Bat Performance*, published in September 2009. The COP is also known as the center of oscillation or the length of a simple pendulum with the same period as a physical pendulum as in a bat oscillating on a pivot. The COP is often used synonymously with the term "sweet spot." In one implementation, the primary tubular region 44 includes the center of percussion and an area plus and minus three inches from the center of percussion. In other implementations, the primary tubular region 44 can have other lengths with respect to the longitudinal axis 14. The length of the primary tubular region 44 is at least one inch, and can be positioned at any location along, or extend the entire length of, the barrel portion 18.

The barrel portion 18 is preferably formed of strong, durable and resilient material, such as, a fiber composite material. In alternative preferred embodiments, the barrel portion 18 can be formed of one or more fiber composite materials in combination with one or more of an aluminum alloy, a titanium alloy, a scandium alloy, steel, other alloys, a thermoplastic material, a thermoset material, and/or wood.

Figure 3:
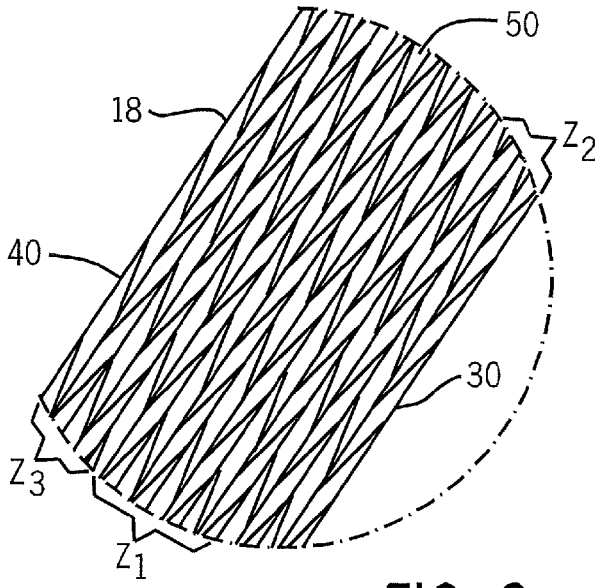
FIG. 3 is an enlarged view of a section of the wall of the barrel portion of the ball bat taken at circle 3 of FIG. 2.
Figure 4:
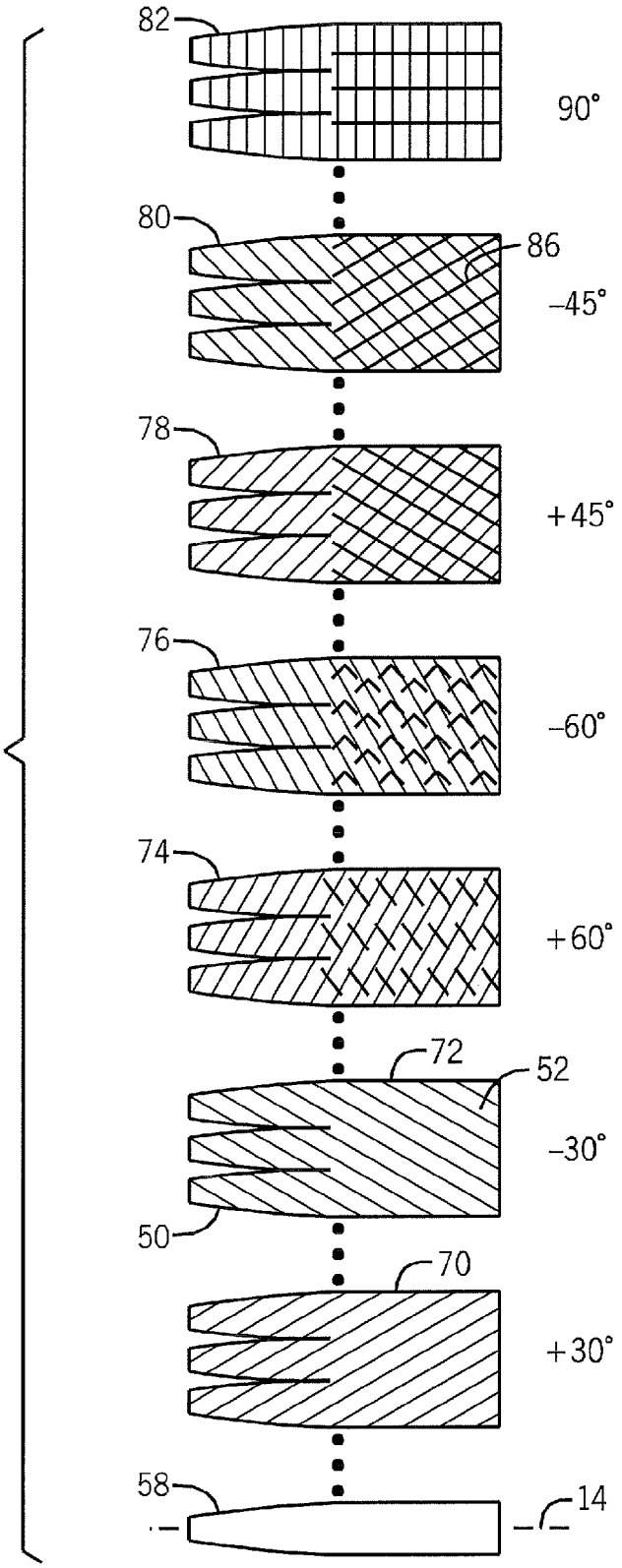
FIG. 4 is side view illustrating a plurality of layers of fiber composite material prior to wrapping around a bladder and mandrel in accordance with a preferred embodiment of the present invention.
Figure 5:
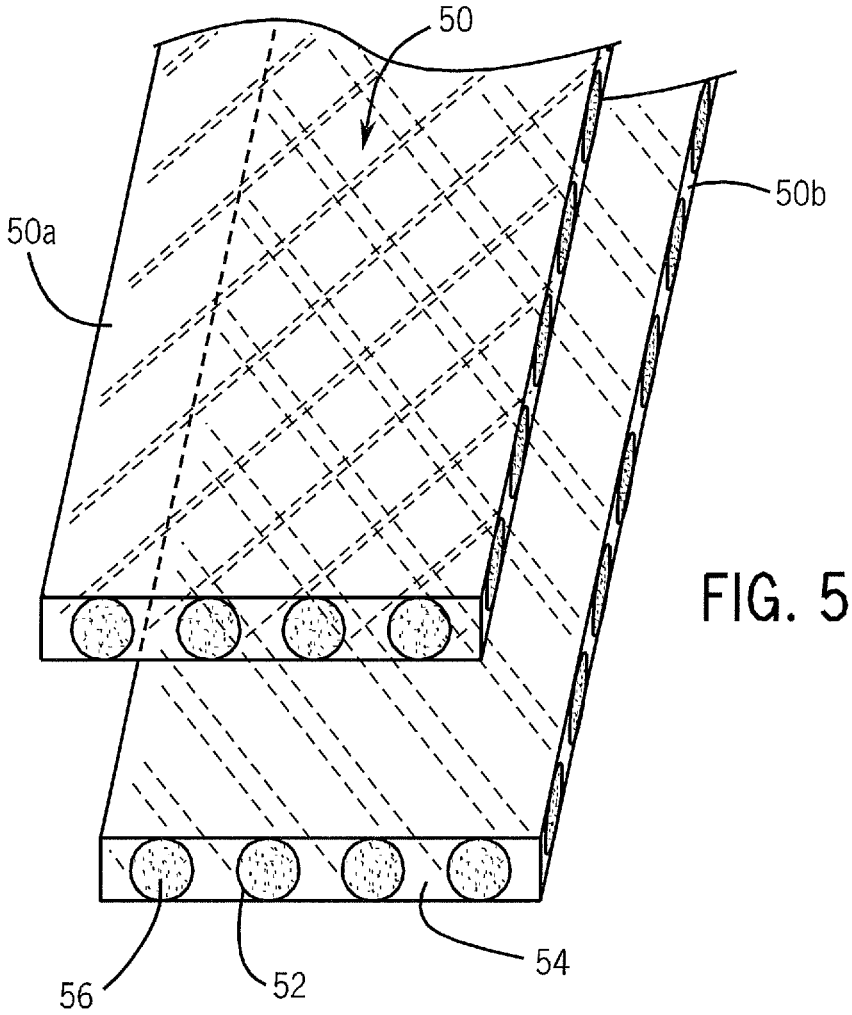
FIG. 5 is a top perspective view of a portion of two representative plies of fiber composite material spaced apart from each other.

Referring to FIGS. 2 through 6, a fiber composite material is preferably used to form at least a portion of the barrel portion 18. As used herein, the terms "composite material" or "fiber composite material" refer to a matrix or a series of plies 50 (also referred to as sheets or layers) of fiber bundles 52 impregnated (or permeated throughout) with a resin 54. Referring to FIGS. 4 and 5, the fiber bundles 52 can be co-axially bundled and aligned in the plies 50.

A single ply 50 typically includes hundreds or thousands of fiber bundles 52 that are initially arranged to extend coaxially and parallel with each other through the resin 54 that is initially uncured. Each of the fiber bundles 52 includes a plurality of fibers 56. The fibers 56 are formed of a high tensile strength material such as carbon. Alternatively, the fibers can be formed of other materials such as, for example, glass, graphite, boron, basalt, carrot, Kevlar®, Spectra®, poly-para-phenylene-2,6-benzobisoxazole (PBO), hemp and combinations thereof. In one set of preferred embodiments, the resin 54 is preferably a thermosetting resin such as epoxy or polyester resins. The resin 54 can be formed of the same material from one ply to another ply. Alternatively, each ply can use a different resin formulation. During heating and curing, the resin 54 can flow between plies 50 and within the fiber bundles 52. The plies 50 preferably typically have a thickness within the range of 0.002 to 0.015 inch. In a particularly preferred embodiment, the ply 50 can have a thickness within the range of 0.005 to 0.006 in. In other alternative preferred embodiments, other thickness ranges can also be used.

The plies 50 are originally formed in flexible sheets or layers. In this configuration, the fibers 56 and the fiber bundles 52 are arranged and aligned such that the fibers 56 generally extend coaxially with respect to each other and are generally parallel to one another. As the ply 50 is wrapped or formed about a bladder 58 and mandrel, or other forming structure, the ply 50 is shaped to follow the form or follow the shape of the bladder 58 and mandrel. Accordingly, the fiber bundles 52 and fibers 56 also wrap around or follow the shape of the bladder 58 or other forming structure. In this formed position or state, the ply 50 is no longer in a flat sheet so the fiber bundles 52 and fibers 56 no longer follow or define generally parallel lines. Rather, the fiber bundles 52 and fibers 56 are adjacent to one another, and are curved or otherwise formed so that they follow substantially the same adjacent paths. For example, if a ply 50 is wrapped about the bladder 58, the ply 50 can take a generally cylindrical or tubular shape and the fiber bundles 52 and fibers 56 can follow the same cylindrical path or define a helical path (depending upon their angle within the ply 50). The fibers 56 remain adjacent to one another, are aligned with each other and follow substantially similar paths that are essentially parallel (or even co-axial) for example, when viewed in a sectional view in a single plane or other small finite segment of the ply 50.

The fibers 56 or fiber bundles 52 are preferably formed such that they extend along the ply 50 and form generally the same angle with respect to an axis, such as the axis 14. The plies 50 are typically identified, at least in part, by the size and polarity of the angle defined by the fibers 56 or fiber bundles 52 with respect to an axis. Examples of such descriptions of the plies 50 can be fibers 56 or fiber bundles 52 defining a positive 30 degree angle, a negative 30 degree angle, a positive 45 degree angle, a negative 45 degree angle, a positive 60 degree angle, a negative 60 degree angle, a positive 70 degree angle, a negative 70 degree angle, a positive 80 degree angle, a negative 80 degree angle, a 90 degree angle (extending perpendicular to the axis 14), and a 0 degree angle (or extending parallel to the axis 14). Other positive or negative angles can also be used. Accordingly, in the present application, a single ply 50 refers to a single layer of fiber composite material in which the fiber bundles 52 extend in substantially the same direction with respect to a longitudinal axis along the single layer, such as plus or positive 45 degrees or minus or negative 60 degrees.

Fiber composite material used to form at least a portion of the handle or barrel portions 16 or 18 of the bat 10 typically includes numerous plies 50. The number of plies 50 used to form a barrel portion 18 can be within the range of 3 to 60. In a preferred embodiment, the number of plies 50 used to form the barrel portion 18, or a primary tubular region thereof, is at least 10 plies. In an alternative preferred embodiment, the number of plies 50 used to form the barrel portion 18, or a primary tubular region thereof, is at least 20 plies. In other implementations, other numbers of plies can be used.

Referring to FIG. 5, fiber composite materials typically are formed or laid-up using pairs of plies 50 having fiber bundles 52 extending in opposite angular polarities. For example, a ply 50*a* formed of fiber bundles 52 and fibers 56 generally extending at a positive 45 degree angle (also referred to as a plus 45 degree ply) will be paired with a second ply 50*b* that is formed with fiber bundles 52 and fibers 56 generally extending at a negative 45 degree angle (also referred to as a negative 45 degree ply). This pattern typically extends throughout a fiber composite material. The alternating angular arrangement of the fiber bundles 52 and fibers 56 is important to achieving and maintaining the structural integrity of the component or structure being formed of the fiber composite material. The overlapped region of the two plies 50*a* and 50*b* can be essential for ensuring that, once cured, the fiber composite material has the desired strength, durability, toughness and/or reliability. The transition between alternating pairs of plies 50 can also support the structural integrity of the composite structure. For example, a series of six plies could include a pair of plus and minus 30 degree plies, followed by a pair of plus and minus 45 degree plies, followed by another pair of plus and minus 30 degree plies. The transition from the minus 30 degree ply to the adjacent plus 45 degree ply also provides added structural integrity to the fiber composite material because an overlapped region, such as region 60, still exists from one ply to an adjacent ply. In other implementations, pairs of plies 50 having opposite polarities but differing fiber angles can be used. In still other implementations, two or more plies can be of the same polarity, such as disclosed by U.S. patent application Ser. No. 13/535,421, hereby incorporated by reference.

Figure 6:
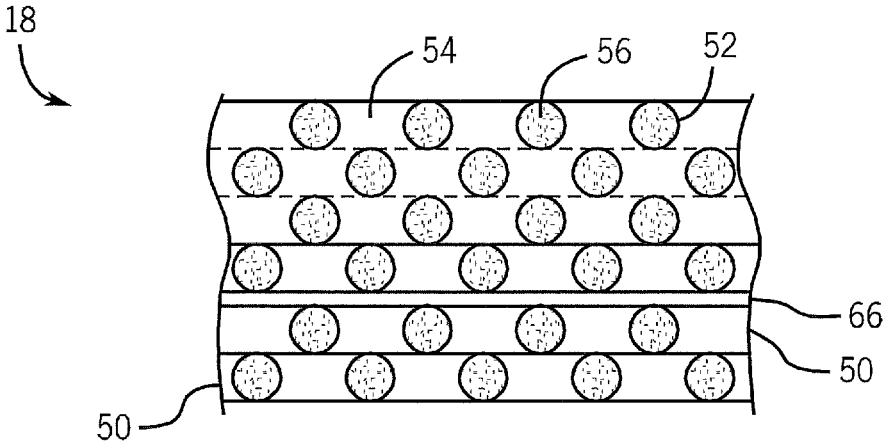
FIG. 6 is an enlarged sectional view of six outer plies of a fiber composite material of a primary tubular region of a barrel portion.

Handle and barrel portions 16 and 18 formed of fiber composite material can include several layers of plus and minus angular plies of different values, such as, for example, plus and minus 30 degree plies, plus and minus 45 degree plies, plus and minus 60 degree plies. One or more layers of 0 degree plies, or 90 degree plies can also be used. Referring to FIG. 6, the plies 50 may be separated at least partially by one or more scrims 66 or veils. The scrim 66 can be used to enable independent movement of the plies 50 above and below the scrim 66 during use after the barrel portion 18 is molded and cured. The scrim 66 can also be used to inhibit, stop or reduce resin flow from one ply 50 to another ply on the opposite side of the scrim 66.

The composite material is typically wrapped about a mandrel that is covered by a bladder 58, the bladder 58 and mandrel once wrapped with the desired number of plies 50 of fiber composite materials is placed into a mold, pressure is applied to the bladder, and the fiber composite material is molded and cured under heat and/or pressure to produce the barrel portion 18 and/or a primary tubular region thereof. While curing, the resin is configured to flow and fully disperse and impregnate the matrix of fiber bundles 52. In alternative embodiments, one or more of the plies, sheet or layers of the composite material can be a braided or weaved sheets or layers. In other alternative preferred embodiments, the one or more plies or the entire fiber composite material can be a mixture of chopped and randomly fibers dispersed in a resin.

Referring to FIG. 4, one implementation of a lay-up of a barrel portion 18 of a bat 10 can be seen. Separate plies 50 are shown, each having separate fiber angles and polarities. The plies 50 are shown as generally flat two-dimensional sheets prior to being placed or wrapped about the bladder 58 positioned over a mandrel. The mandrel is formed in a shape that defines the inner volume of a tubular barrel portion upon the completion of the molding and curing. The bladder 58, when placed in the mold, is pressurized to exert a force or pressure onto the plies 50 ensuring that the plies conform to the shape of the mold and achieve proper compaction, and the desired wall thickness, etc. For example, the bladder can be pressurized to 150 psi. In other molding operations, other pressure values can be used. The bladder 58 and mandrel can be formed of any material that maintains its shape and integrity during the curing process, such as a polyurethane bladder over a wooden mandrel. Once the bladder 58 is in position, the process of "laying up" the plies 50, or layers, comprising the fiber composite material can be performed. The shape and overall size of the plies 50 can vary from one to another. Each ply can be sized to extend about all or a portion of the underlying bladder 58/mandrel or the underlying ply 50. Preferably, the ply 50 is sized to extend or wrap around the entire or full circumference of the bladder and about the axis 14. A plurality of uncured plies 50 of fiber composite material can be wrapped or otherwise applied about the bladder 58.

Once the lay-up of the desired number of plies 50 is completed, the bladder 58 and mandrel with the wrapped composite layers or plies are placed into a mold, the bladder is pressurized, the mold is heated to form (mold and cure) the barrel portion 18. After curing, the bladder 58 and the mandrel can be removed from the inner surface of the barrel portion 18 through conventional means, such as, for example, extraction or heating.

As referenced in the Background of the Invention, in some applications, it is desirable to produce a barrel portion formed of fiber composite material having high angle fibers (fiber composite material having fiber angles of 45 degrees or greater). The use of high fiber angles for the production of unidirectional fiber composite components, including a barrel portion or cylindrical portions of a barrel portion, can be desirable because the stiffness of the barrel portion, or a primary tubular region thereof, can be greatly increased without adding to the weight or the wall thickness of the barrel portion.

However, the use of fiber composite material having plies of high angle fibers used to produce a barrel portion, or a cylindrical portion thereof, can raise many difficulties. The high fiber angles severely restrict the expansion of the fiber composite material during bladder molding. As a result, it is difficult to consistently achieve a well-compacted, consolidated barrel portion (or primary tubular region thereof). The restriction can result in wrinkles in the fibers, the formation of voids and areas of porosity within the fiber composite material, poor compaction and inconsistent wall thickness. These issues can severely reduce the durability and performance of the barrel portion, and can negatively affect its cosmetic appearance.

The co-inventors have identified and discovered that the benefits of using fiber composite material having high fiber angles can be achieved without the numerous negative side effects by sectioning the fibers of the fiber composite material so that the plies of high angle fibers expand to fully engage the mold and to provide for exceptional compaction and consistency of the molded tubular body.

Referring to FIG. 4, in one implementation a ply 70 represents the innermost ply 50 or layer applied to the bladder 58, a ply 72 is positioned over ply 70. In one preferred method of laying up the barrel portion 18, the plies 70 and 72 can be initially laid over each other and then wrapped over about the barrel portion as a pair of plies having opposite polarities. In other preferred methods, a single ply or three or more plies can be applied or wrapped about the bladder/mandrel as a single ply layer or a triple or higher ply layer. Plies 74 through 82 illustrate one potential lay-up of layers to a bladder/mandrel. Each of the plies 74 through 82 includes high angle fibers of 45 degrees or higher with respect to the longitudinal axis 14, and a plurality of sections 86 or cuts have been made to the plies 74 through 82 to make the fibers discontinuous from one edge of the ply to an opposing edge of the ply. FIG. 4 illustrates the five high angle plies 74 through 82. However, in other implementations, other numbers of high angle plies can be used in the lay-up, laminate or wall thickness of the molded barrel portion 18 or primary tubular region thereof.

Referring to FIG. 3, one implementation of a lay-up or laminate or wall-thickness of the barrel portion 18 is illustrated. The barrel portion 18 preferably includes a wall thickness of at least 0.100 inch and a plurality of the fiber composite plies 50. The wall thickness can include an intermediate zone $Z_1$ positioned between inner and outer zones $Z_2$ and $Z_3$ respectfully. Each of the zones can include at least two plies. The wall thickness of the barrel portion preferably includes at least two high angle fiber plies 50 positioned in one of the zones ($Z_1$, $Z_2$ or $Z_3$), two or more of the zones, or all three of the zones $Z_1$, $Z_2$ and $Z_3$.

The plies 50 of high angle fibers can be spaced apart with respect to each other in the lay-up or laminate. A high angle fiber ply positioned as the outermost ply 50 in outer zone Z3 can be useful as an indicator of rolling. Bat rolling and other barrel compression practices are commonly performed by "bat doctors" in efforts to create an illegal more responsive ball bat. In such a configuration, the ball bat 10 may not crack or show other evidence of failure during normal use, but if the bat undergoes a rolling operation (such as the advanced break test ("ABI") wherein the outer diameter of the barrel portion is compressed), the high angle outermost ply 50 can fail causing a crack to be seen on the outer surface of the barrel portion. ABI tests are used to detect if the performance of a ball bat improves after rolling to such a degree so as to exceed established performance limits. The ABI test can be used as a measure for how a bat will perform after having been rolled or after having been used over an extended period of time. Bats whose performance improves after rolling are rejected. A ball bat that exhibits cracks after or during performance of the bat rolling procedure is considered to have passed such ABI tests. A high angle fiber ply 50 positioned at or near the outermost position of the barrel portion (or primary tubular region thereof) generally requires less expansion and expands less in a radial direction because the ply 50 is already positioned adjacent to the surface of the mold. However, high angle plies 50 positioned away from the outermost ply, such as plies in the intermediate zone Z1 and the inner zone Z2 can undergo expansion during molding and can be subjected to significant outward radial forces from the pressure of the bladder and the heat of the molding process. The high fiber angles generally resist or inhibit such expansion resulting in the negative characteristics from molding discussed above. When the fibers of the high angle plies 50 are sectioned, the high angle plies 50, even if positioned in zone Z1 or zone Z2 can expand during molding to provide better compaction, consistent desired wall thickness and improved performance. The discontinuous sectioned fibers of the high angle plies 50 can facilitate resin flow during molding.

Figure 7:
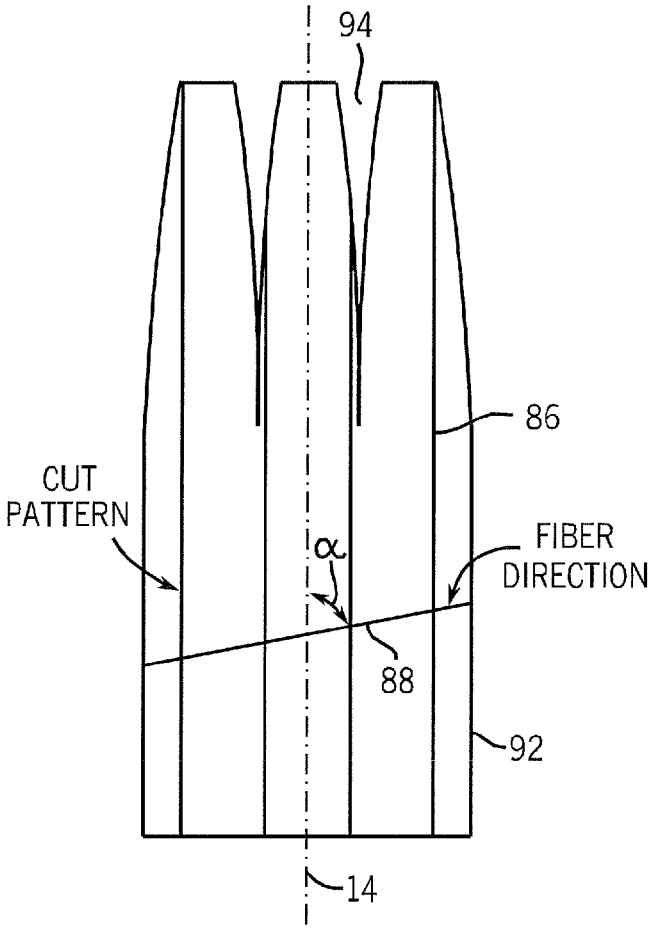
FIG. 7 is a top view of a ply of fiber composite material for forming a barrel portion prior to wrapping in accordance with a preferred embodiment of the present invention.

Referring FIG. 7, in one implementation the high angle fibers of the ply 50 are sectioned or cut by the plurality of section lines 86 extending parallel to the axis 14. One of the high angle fibers is indicated as item 88. Angle $\alpha$ illustrates how the angle of the fibers of a high angle ply 50 can be measured. The angle $\alpha$ can be 80 degrees. The angle $\alpha$ is preferably within the range of 45 degrees to 90 degrees. The ply 50 is shaped and sized to extend around the bladder 58 and mandrel. The ply 50 has a width or side dimension that can be measured from a first side edge 90 to a second side edge 92 that is sized to wrap around the full circumference of the mandrel to contribute to the formation of the tubular barrel portion. The ply 50 can define a plurality of cut-outs or slits 94 that are sized to facilitate the wrapping of the ply 50 about the tapered region of the mandrel and bladder 58 without using unnecessary material and overlapping of material. The section lines 86 make the fibers 88 discontinuous from a first side edge 90 to a second side edge 92. The fibers 88 are sectioned such that the fibers 88 do not extend about the full circumference of the barrel portion 18 or a primary tubular region thereof. In one implementation, the sectioned or discontinuous fibers 88 extend over at least 80 percent of the circumference of the barrel portion 18 or the primary tubular element thereof. In another implementation, the sectioned or discontinuous fibers 88 extend over at least 90 percent of the circumference of the barrel portion 18 or the primary tubular element thereof. In other implementations, the discontinuous fibers can extend over other percentages of the barrel portion. The section lines 86 are illustrated extending the entire length of the ply 50 and define a particular section pattern or cut pattern. Accordingly, the benefits of the sectioning or cutting of the high angle fibers 88 can extend over the entire ply 50. The section lines 86 can be created by cutting, slicing, chopping, punching, or other separating techniques. In another implementation, the section lines 86 can be formed in the ply 50 by forming a plurality of sub-plies and laying up the sub-plies adjacent to each other to form the ply 50.

Figure 8:
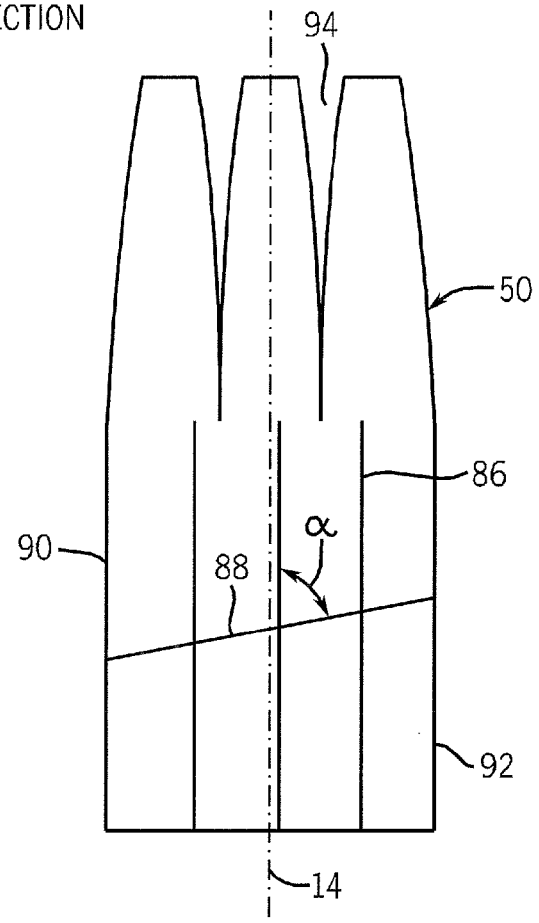
FIGS. 8 through 10 illustrate top views of a ply of fiber composite material for forming a barrel portion prior to wrapping in accordance with alternative preferred embodiments of the present invention.

Referring to FIG. 8, in another implementation the section lines 86 can extend over only a region or part of the total length of the ply 50 with respect to the axis 14. The ply 50 can be substantially similar to the ply 50 of FIG. 7 with the exception of the section lines 86. The section lines 86 extend parallel to the axis 14 and section the fibers of the fiber composite material forming the ply 50 such that the high angle fibers 88 are sectioned and do not continuously extend from the first edge 90 of the ply to the second edge 92. The section lines 86 of FIG. 8 enable only a primary tubular region, such as the ball impact region 44, of the barrel portion 18 to include the high angle fiber ply with discontinuous fibers extending about the circumference of the barrel portion 18. In other implementations, the length of the section lines 86 with respect to the axis 14 can be adjusted to be shorter or longer than illustrated in FIG. 8. In another implementation, the section lines 86 can be longitudinally spaced apart sections formed in the ply.

Figure 9:
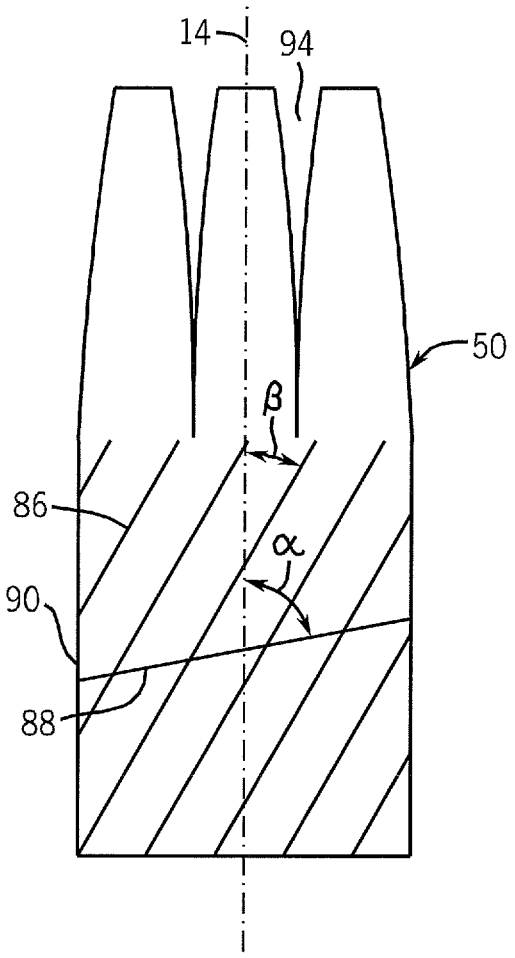

Referring to FIG. 9, in another implementation the section lines 86 can extend over only a region or part of the total length of the ply 50 with respect to the axis 14. The ply 50 can be substantially similar to the ply 50 of FIG. 7 with the exception of the section lines 86. The section lines 86 can extend at a section line angle $\beta$ with respect to the axis 14. The section line angle $\beta$ is sufficiently different from the fiber angle such that the section line 86 intersects the fibers 88 and results in a section or cut to the fibers at the intersection. In the implementation of FIG. 9, the angle β is approximately 30 degrees and the angle α is approximately 80 degrees for an angular difference of 50 degrees. In other implementations, other angular differences can be used provided the number and length of the section in combination with the angle β are sufficient to section the high angle fibers 88 extending from the first edge 90 of the ply 50 to the second edge 92 of the ply. The section lines 86 section the fibers of the fiber composite material forming the ply 50 such that the fibers 88 do not continuously extend from the first edge 90 of the ply to the second edge 92. The section lines 86 of FIG. 9 enable only a primary tubular region, such as the ball impact region 44, of the barrel portion 18 to include the high angle fiber composite material with discontinuous fibers extending about the circumference of the barrel portion 18. In other implementations, the length of the section lines 86 can be adjusted to be shorter or longer than illustrated in FIG. 9.

Figure 10:
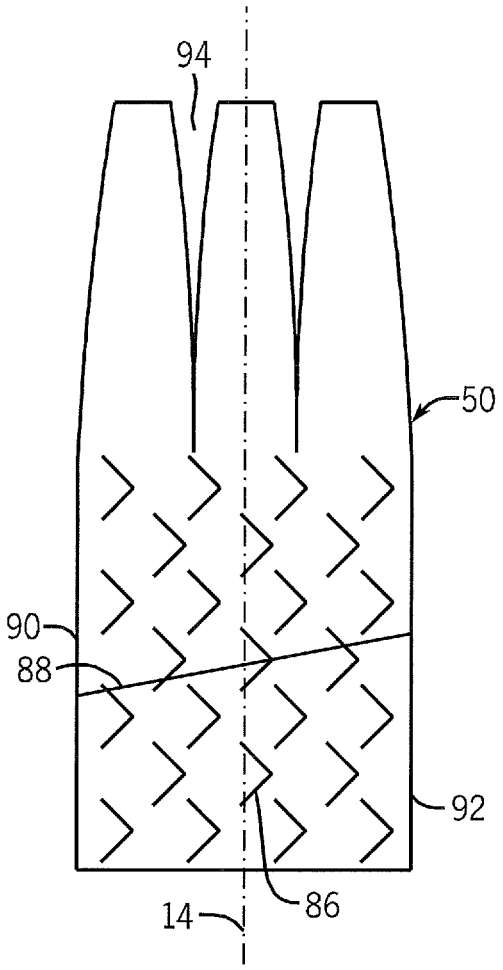

Referring to FIG. 10, in another implementation the sections 86 of the fibers 88 of the fiber composite material can be a plurality of pairs of angled line segments. The sections 86 can form a section pattern extending over the barrel portion 18 or the desired primary tubular region thereof. The ply 50 can be substantially similar to the ply 50 of FIG. 7 with the exception of the sections 86. The sections 86 include two line segments extending separate angles with respect to the axis 14. These angles are sufficiently different from the fiber angle such that the sections 86 intersect the fibers 88 and results in a section or cut to the fibers 88 at the intersection. In other implementations, other configurations for the sections can be used including other angled shapes, other numbers of line segments, curved shapes, and other irregular shapes provided that the sections are sufficient to section the high angle fibers 88 extending from the first edge 90 of the ply 50 to the second edge 92 of the ply. The sections 86 section the fibers of the fiber composite material forming the ply 50 such that the fibers 88 do not continuously extend from the first edge 90 of the ply to the second edge 92. The sections 86 of FIG. 10 enable only a primary tubular region, such as the ball impact region 44, of the barrel portion 18 to include the high angle fiber composite material with discontinuous fibers extending about the circumference of the barrel portion 18. In other implementations, the extent of the section pattern formed by the plurality of the sections 86 can be varied from that illustrated in FIG. 10.

Figure 11:
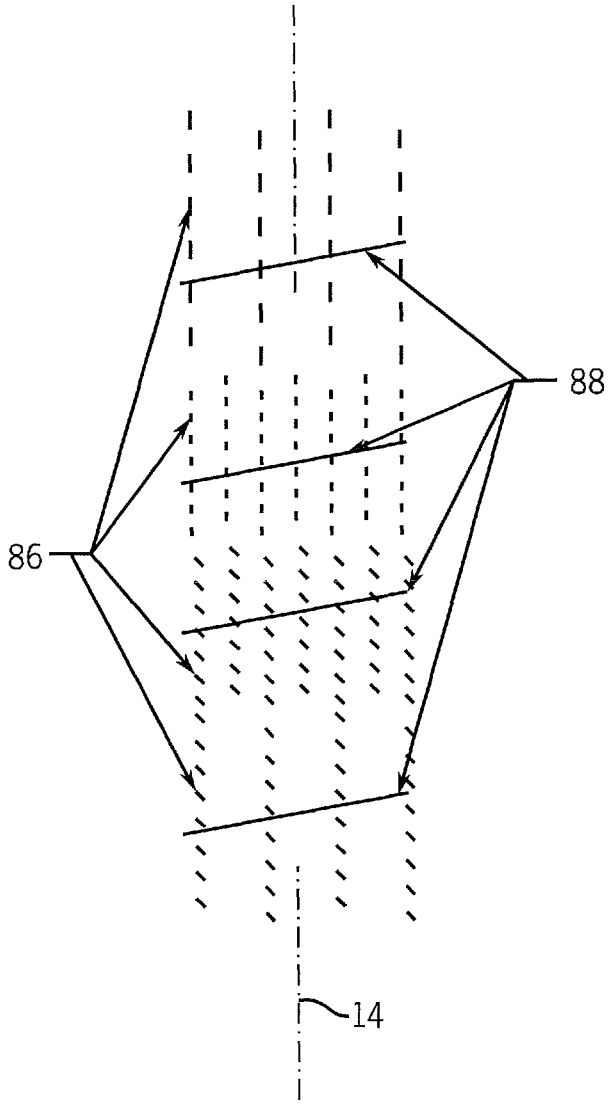
FIG. 11 is a top view of a ply of fiber composite material for forming a primary tubular region of a barrel portion prior to wrapping in accordance with an alternative preferred embodiment of the present invention.

Referring to FIG. 11 in other implementations, other patterns of sections 86 that can be used in the ply 50 are shown. The sections 86 can vary in length, angle with respect to the axis 14, and spacing within the ply 50. The sections 86 can form a section pattern extending over the barrel portion 18 or the desired primary tubular region thereof. The ply 50 can be substantially similar to the ply 50 of FIG. 7 with the exception of the sections 86. The pattern of sections is preferably sufficient section or cut to the fibers 88 at the intersection. In other implementations, other configurations for the sections can be used including other angled shapes, other numbers of line segments, curved shapes, and other irregular shapes. The sections 86 preferably section the fibers 88 of the fiber composite material forming the ply 50 such that the fibers 88 do not continuously extend from the first edge of the ply to the second edge.

Figure 12A:
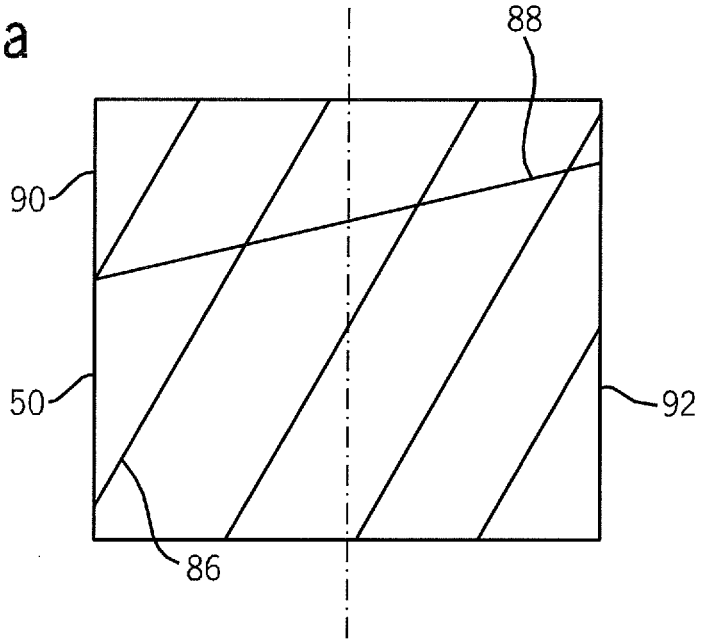
FIGS. 12*a* and 12*b* illustrate top views of a ply of fiber composite material for forming a primary tubular region of a barrel portion prior to wrapping in accordance with an alternative preferred embodiment of the present invention.
Figure 12B:
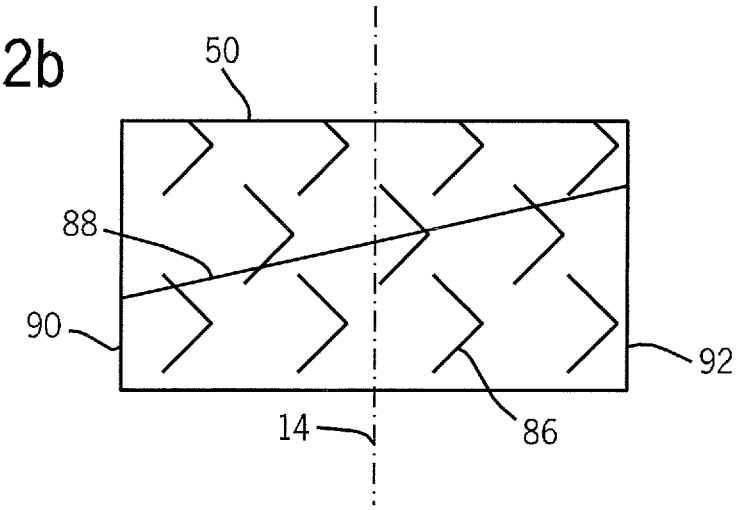

Referring to FIGS. 12*a* and 12*b*, the ply 50 can take different shapes. For example, the length of the ply 50 with respect to the axis 14 can be less than the full length of the barrel portion 18. The ply 50 can be used to form a primary tubular region of the barrel portion 18. The length of the ply 50 or the primary tubular region is at least one inch when measured with respect to the longitudinal axis 14. The ply 50 can be positioned at any desired position along the length of the barrel portion. In this manner, the positioning of the ply 50 of high fiber angle fiber composite material can be positioned at the exact desired location to achieve the desired result for that particular barrel portion 18. The ply 50 can be substantially similar to the ply 50 of FIG. 7 with the exception of the section lines 86 and the length (and/or width) of the ply 50. FIGS. 12*a* and 12*b* illustrate to implementations of sections 86. Other shapes, lengths and spacing of the sections are contemplated under the present invention. The sections 86 section the fibers of the fiber composite material forming the ply 50 such that the fibers 88 do not continuously extend from the first edge 90 of the ply to the second edge 92.

Figure 13:
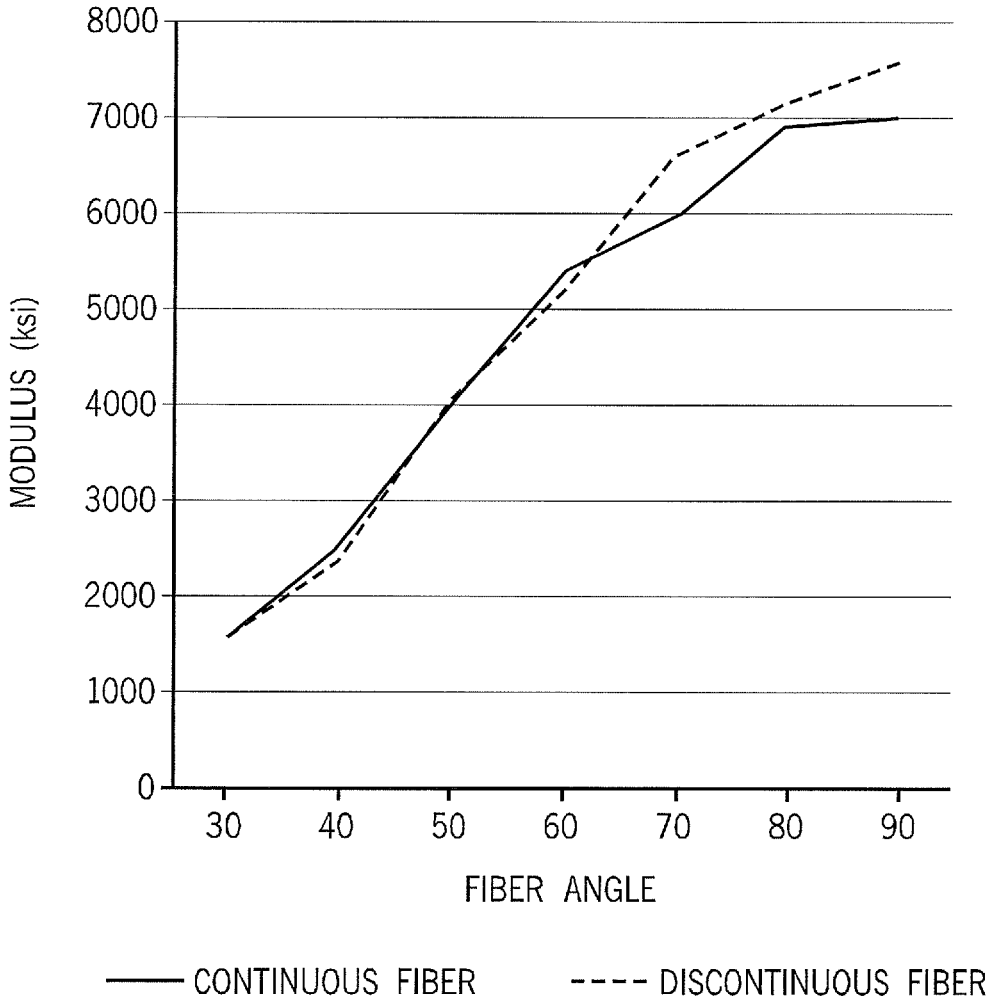
FIG. 13 is a graph illustrating the modulus of a set of primary tubular regions of a barrel portion of a ball bat formed of fiber composite material having different fiber angles with respect to a longitudinal axis.

Referring to FIG. 13, a table illustrates the change in modulus of elasticity (E) of the barrel portions 18 formed of fiber composite material of different fiber angles of non-sectioned, continuous fibers, and barrel portions formed of fiber composite material of different angles wherein the fibers are sectioned in the manner illustrated in FIG. 8. The barrel portions 18 used to obtain the data for the table of FIG. 13 were formed of the same fiber composite material with the plies 50 shaped like the ply of FIG. 8. Two barrel portions were formed having lay-ups or wall thicknesses formed of plies of fiber composite material having plus and minus 30 degree fibers. One of the barrel portions included fibers that were not sectioned and therefore continuous about the ply from the first side edge to the second side edge of the ply. The other of the pair of barrel portions included plies of fiber composite material wherein the fibers were sectioned such that the fibers were discontinuous from the first side edge of the ply to the second side edge of the ply. This process was repeated for several other pairs of barrel portion for different fiber angles up to 90 degrees. The barrel portions formed of the different fiber angles were each tested for deflection using a universal test machine, such as the universal test machine produced by Tinius Olsen Testing Machine Co., Inc. of Willow Grove, Pa. The deflection was measured under a known load, and the modulus of elasticity of the barrel portion is obtained from the deflection data.

$$E = \text{stress} \div \text{strain} = \text{psi} \div \text{in/in} = \text{psi}.$$

As stated in the Background of the Invention, barrel portions of a ball bats formed of fiber composite material having high fiber angles are difficult to bladder mold due to the high angle fibers resisting expansion of the fiber composite plies/layers during molding. As a result, such barrel portions can be difficult to manufacture and can often have poor composite quality and or performance characteristics. However, plies formed of high angle fiber composite material are known to have high levels of stiffness and high values of modulus of elasticity. One of skill in the art, would not consider sectioning or cutting the high angle fibers because one of skill in the art would expect the stiffness or modulus of elasticity of the barrel portion or a primary tubular region thereof to be substantially reduced.

However, contrary to such conventional thinking, the co-inventors of the present application have discovered following extensive consideration and testing of alternate barrel configurations, that the sectioning of the fibers of fiber composite material having high fiber angles does not significantly reduce the modulus or stiffness of the barrel portion. FIG. 13 includes two curved lines representing the results of the deflection testing of the barrel portions form with continuous fibers and barrel portions formed with discontinuous or sectioned fibers. Contrary to the expected result, it was discovered that the modulus of elasticity and stiffness of the barrel portion is not significantly decreased by the sectioning of the fibers of the fiber composite material. At fiber angles from 30 degrees to 60 degrees, the modulus of elasticity readings are substantially the same for the barrel portions formed of continuous fibers compared to the barrel portions formed of discontinuous or sectioned fibers. For barrel portions formed of high angle fibers of greater than 60 degrees the modulus of elasticity of the barrel portions was very similar with only a minimal difference in the modulus of elasticity values between the barrel portions formed of fiber composite material with continuous high angle fibers and the barrel portions formed of fiber composite material with discontinuous high angle fibers. Significantly, the modulus of elasticity test data illustrates that by sectioning the high angle fibers of plies of fiber composite material, no significant decrease in the modulus of elasticity, and therefore the stiffness, of the barrel portion was found. Therefore, by sectioning the high angle fibers of the fiber composite material, one can overcome the significant negative factors involved in the bladder molding of fiber composite material of high angle fibers without sacrificing the modulus of elasticity and stiffness of the barrel portion.

Figure 14:
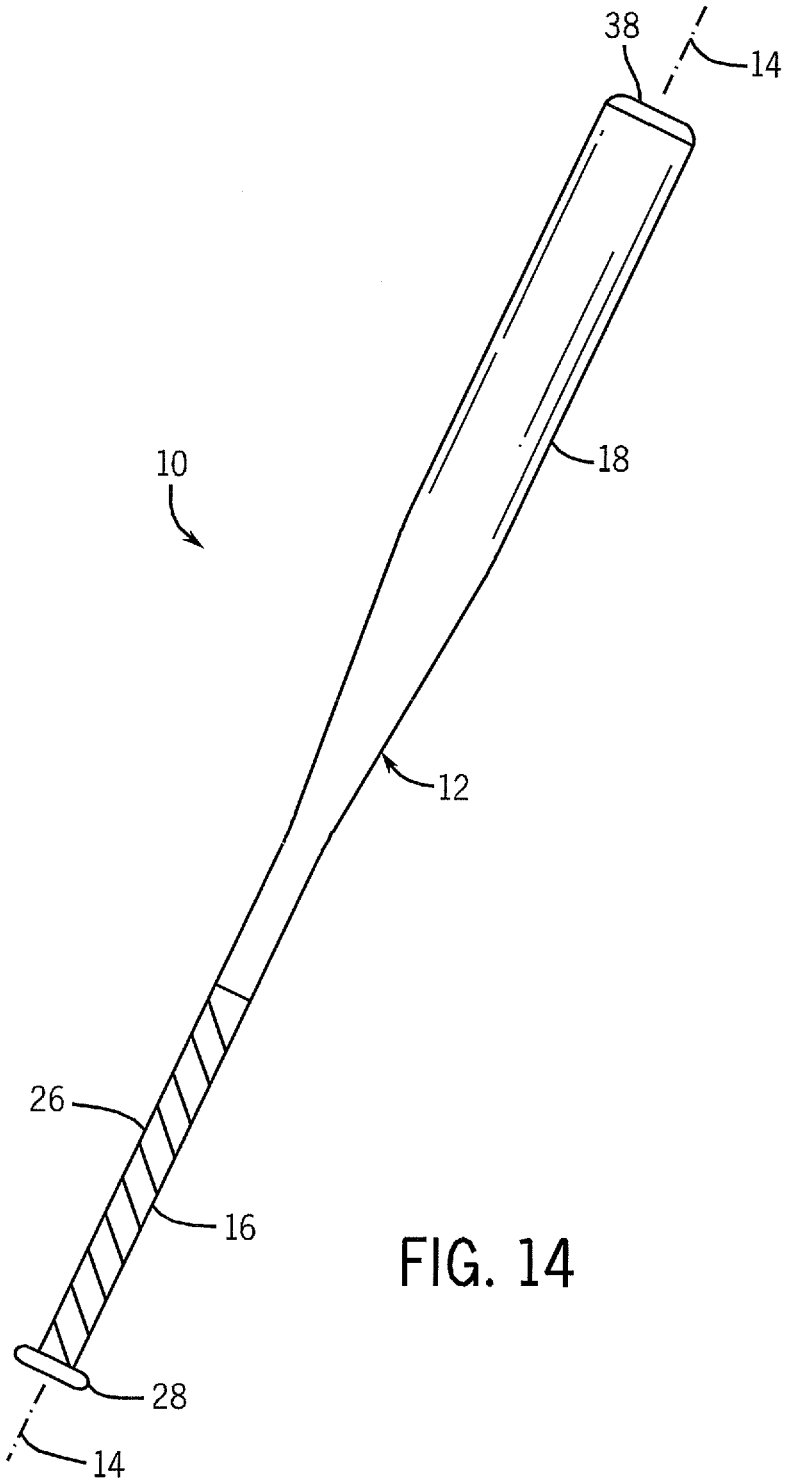
FIG. 14 is a side view of a ball bat in accordance with another preferred embodiment of the present invention.

Referring to FIG. 14, in an alternative preferred embodiment, the bat frame 12 of the bat 10 can be formed as a one piece, integral structure. The bat frame 12 includes the handle and barrel portions 16 and 18, but they are formed as single, one-piece body. In other words, the bat frame 12 is not produced as a separate handle and barrel portions that are bonded, molded or otherwise attached together. The use of fiber composite material in the embodiments discussed above for the barrel portion 18 are equally applicable to the one piece bat frame 12.

The bat 10 of the present invention provides numerous advantages over existing ball bats. One such advantage is that the bat 10 of the present invention is configured for competitive, organized baseball or softball. For example, embodiments of ball bats built in accordance with the present invention can fully meet the bat standards and/or requirements of one or more of the following baseball and softball organizations: ASA Bat Testing and Certification Program Requirements; United States Specialty Sports Association ("USSSA") Bat Performance Standards for baseball and softball; International Softball Federation ("ISF") Bat Certification Standards; National Softball Association ("NSA") Bat Standards; Independent Softball Association ("ISA") Bat Requirements; Ball Exit Speed Ratio ("BESR") Certification Requirements of the National Federation of State High School Associations ("NFHS"); Little League Baseball Bat Equipment Evaluation Requirements; PONY Baseball/Softball Bat Requirements; Babe Ruth League Baseball Bat Requirements; American Amateur Baseball Congress ("AABC") Baseball Bat Requirements; and, especially, the NCAA BBCOR Standard or Protocol.

Accordingly, the term "bat configured for organized, competitive play" refers to a bat that fully meets the ball bat standards and/or requirements of, and is fully functional for play in, one or more of the above listed organizations.

The present invention enables ball bats 10 and barrel portions 18 including a plurality of plies of high angle fiber composite material to be produced in a cost effective, reliable and high quality manner. The present invention provides a system or process of developing a ball bat formed at least in part of high angle fiber composite material that provides a high quality cosmetic appearance, is highly durable, and provides the desired operational characteristics. The present invention provides a method and system for producing a ball bat including a barrel portion formed of a high angle fiber composite material that can satisfy performance requirements, such as, for example, BBCOR certification, without adding too much weight or wall thickness to the barrel portion. The present invention also provides a ball bat with a desirable level of barrel stiffness, exceptional feel and performance.

While the preferred embodiments of the invention have been illustrated and described, it will be appreciated that various changes can be made therein without departing from the spirit and scope of the invention. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A ball bat extending along a longitudinal axis, the bat comprising:

a barrel portion defining a primary tubular region, the barrel portion formed at least in part of a fiber composite material, the fiber composite material including at least first and second plies, the first ply including a first plurality of fibers aligned adjacent to one another and a first resin, and the second ply including a second plurality of fibers aligned adjacent to one another and a second resin, substantially all of the first and second pluralities of fibers of the first and second plies being generally aligned to define first and second angles with respect to the longitudinal axis, respectively, the first and second angles each being within the range of 45 to 90 degrees, each of the first and second plies being sized to extend about the full circumference of the barrel portion, the first and second pluralities of fibers being sectioned in at least two spaced apart locations such that the fibers do not continuously extend about half of the full circumference of the primary tubular region, the sectioned first plurality of fibers of the first ply retaining their angular alignment with respect to the longitudinal axis and the sectioned second plurality of fibers of the second ply retaining their angular alignment with respect to the longitudinal axis.

2. The ball bat of claim 1, wherein the primary tubular region has a length measured with respect to the longitudinal axis of at least 1 inch.

3. The ball bat of claim 2, wherein the primary tubular region is positioned at or within plus or minus three inches of the center of percussion of the barrel portion of the bat.

4. The ball bat of claim 1, wherein the primary tubular region has a wall thickness of at least 0.100 inch.

5. The ball bat of claim 1, wherein barrel portion is formed entirely of a fiber composite material.

6. The ball bat of claim 1, wherein the at least first and second plies includes first, second and third plies, wherein the third ply includes a third plurality of fibers aligned adjacent to one another and a third resin, and wherein the third plurality of fibers are generally aligned to define a third angle with respect to the longitudinal axis, and wherein the third angle is within the range of 45 to 90 degrees.

7. The ball bat of claim 6, wherein the third plurality of fibers are sectioned such that the fibers do not continuously extend about the full circumference of the primary tubular ball impact region.

8. The ball bat of claim 1, wherein the second ply is positioned over, and is within 0.002 in of, the first ply.

9. The ball bat of claim 6, wherein the at least first, second and third plies is at least ten plies.

10. The ball bat of claim 1 wherein the first and second resins are formed of substantially the same resin material.

11. The ball bat of claim 1, the first and second pluralities of fibers are selected from the group consisting of carbon fibers, graphite fibers, glass fibers, boron fibers, basalt fibers, carrot fibers, Kevlar® fibers, Spectra® fibers, poly-para-phenylene-2, 6-benzobisoxazole (PBO) fibers, hemp fibers and combinations thereof.

12. The ball bat of claim 1, further comprising a handle portion, and wherein the barrel portion is coupled to the handle portion.

13. The ball bat of claim 1, further comprising a handle portion integrally formed with the barrel portion to form a one piece bat frame.

14. The ball bat of claim 1, wherein each of the first and second plies has a thickness of within the range 0.002 to 0.015 inch.

15. The ball bat of claim 1, wherein the first and second pluralities of fibers are sectioned in at least three spaced apart locations.

16. The ball bat of claim 1, wherein, when the bat is tested in accordance with the NCAA Standard for Testing Baseball Bat Performance, the bat has a maximum BBCOR value of less than or equal to 0.500.

17. The ball bat of claim 1, wherein the at least first and second plies includes first, second and third plies, wherein the third ply includes a third plurality of fibers aligned adjacent to one another and a third resin, wherein the third plurality of fibers are generally aligned to define a third angle with respect to the longitudinal axis, and wherein the third angle is less than 45 degrees, and wherein the third plurality of fibers are not sectioned.

18. The ball bat of claim 15, wherein each of the first and second plies has a thickness of within the range 0.005 to 0.006 inch.

* * * * *